US010202972B2

(12) United States Patent
Zimmerman, Jr.

(10) Patent No.: US 10,202,972 B2
(45) Date of Patent: Feb. 12, 2019

(54) PLUNGER LIFT ASSEMBLY WITH AN IMPROVED FREE PISTON ASSEMBLY

(71) Applicant: SUPEIROR ENERGY SERVICES, L.L.C., Houston, TX (US)

(72) Inventor: Jeffrey Brian Zimmerman, Jr., Denver, CO (US)

(73) Assignee: SUPERIOR ENERGY SERVICES, L.L.C., Houston, TX (US)

( * ) Notice: Subject to any disclaimer, the term of this patent is extended or adjusted under 35 U.S.C. 154(b) by 0 days.

(21) Appl. No.: 15/957,841

(22) Filed: Apr. 19, 2018

(65) Prior Publication Data

US 2018/0238321 A1 Aug. 23, 2018

Related U.S. Application Data

(63) Continuation of application No. 14/472,044, filed on Aug. 28, 2014, now Pat. No. 9,976,548.

(51) Int. Cl.

| | |
|---|---|
| ***F04B 47/12*** | (2006.01) |
| ***E21B 43/12*** | (2006.01) |
| ***F04B 31/00*** | (2006.01) |

(52) U.S. Cl.

CPC ..... *F04B 47/12* (2013.01); *E21B 43/121* (2013.01); *F04B 31/00* (2013.01)

(58) Field of Classification Search

CPC .... E21B 43/121; E21B 43/128; E21B 43/122; E21B 43/123; E21B 43/00; E21B 34/06; F04B 39/0016; F04B 47/00; F04B 47/12; F04B 31/00; F04C 13/008

See application file for complete search history.

(56) References Cited

U.S. PATENT DOCUMENTS

| | | | |
|---|---|---|---|
| 2,878,754 | A | 3/1959 | McMurry |
| 3,029,872 | A | 4/1962 | Hanes |
| 4,239,458 | A | 12/1980 | Yeatts |

(Continued)

FOREIGN PATENT DOCUMENTS

WO WO2013131165 A1 9/2013

OTHER PUBLICATIONS

International Search Report and Written Opinion PCT/US2015/042038 dated Oct. 7, 2015.

(Continued)

*Primary Examiner* — Wei Wang

(74) *Attorney, Agent, or Firm* — Winston & Strawn LLP

(57) ABSTRACT

An improved free piston assembly for use in combination with a plunger lift assembly is provided. The piston assembly includes a sleeve member, a retention sleeve, and a flow restriction member. The sleeve member has an inner surface defining an opening for the flow of formation fluids. The opening includes a first section and a second section. The retention sleeve is configured to be affixed to the first section of the opening. The flow restriction member is not latched to the sleeve member and is configured to have an interference fit with the retention sleeve. The interference fit provides a force that is sufficient to overcome the force of gravity on the flow restriction member when formation fluid forces acting on the flow restriction member are decreased or removed. The second section of the opening is configured to prevent the passage of the flow restriction member.

13 Claims, 7 Drawing Sheets

(56) References Cited

U.S. PATENT DOCUMENTS

| | | | |
|---|---|---|---|
| 5,341,539 | A | 8/1994 | Sheppard et al. |
| 6,148,923 | A | 11/2000 | Casey |
| 6,209,637 | B1 | 4/2001 | Wells |
| 6,293,340 | B1 | 9/2001 | Wu |
| 6,467,541 | B1 | 10/2002 | Wells |
| 6,719,060 | B1 | 4/2004 | Wells |
| 6,883,612 | B2 | 4/2005 | Ferguson et al. |
| 6,935,427 | B1 | 8/2005 | Billingsley |
| 7,188,670 | B2 | 3/2007 | Amies et al. |
| 7,383,878 | B1 | 6/2008 | Victor |
| 8,181,706 | B2 | 5/2012 | Tanton |
| 8,327,931 | B2 | 12/2012 | Agrawal et al. |
| 8,347,955 | B1 | 1/2013 | Sewell et al. |
| 8,403,307 | B2 | 3/2013 | Koeske et al. |
| 8,528,633 | B2 | 9/2013 | Agrawal et al. |
| 8,573,295 | B2 | 11/2013 | Johnson et al. |
| 8,714,268 | B2 | 5/2014 | Agrawal et al. |
| 9,068,443 | B2 | 6/2015 | Jeffries et al. |
| 2003/0094283 | A1 | 5/2003 | Ivannikov et al. |
| 2005/0161223 | A1 | 7/2005 | Shulyatikov et al. |
| 2005/0241819 | A1* | 11/2005 | Victor ..... E21B 43/127 166/68 |
| 2007/0246211 | A1 | 10/2007 | Schneider et al. |
| 2008/0271898 | A1 | 11/2008 | Turley et al. |
| 2010/0084138 | A1 | 4/2010 | Inglis |
| 2010/0089591 | A1 | 4/2010 | Thomson et al. |
| 2012/0080198 | A1 | 4/2012 | Lembcke |
| 2012/0217021 | A1 | 8/2012 | Cravatte et al. |
| 2012/0305243 | A1 | 12/2012 | Hallundbaek et al. |
| 2013/0168099 | A1 | 7/2013 | Themig |
| 2014/0116714 | A1 | 5/2014 | Jefferies |
| 2015/0300136 | A1 | 10/2015 | Jefferies et al. |
| 2015/0322753 | A1 | 11/2015 | Zimmerman, Jr. |
| 2016/0061012 | A1 | 3/2016 | Zimmerman, Jr. |

OTHER PUBLICATIONS

International Search Report and Written Opinion PCT/US2015/029027 dated Aug. 5, 2015.

* cited by examiner

PLUNGER LIFT ASSEMBLY WITH AN IMPROVED FREE PISTON ASSEMBLY

CROSS-REFERENCE TO RELATED APPLICATION

This application is a Continuation of U.S. patent application Ser. No. 14/472,044, filed Aug. 28, 2014 the entire content of which is expressly incorporated herein by reference thereto.

FIELD OF TILE INVENTION

This invention relates to a plunger lift for moving liquids upwardly in a hydrocarbon well and more particularly to an improved free piston assembly that is an integral part of the plunger lift assembly.

BACKGROUND OF THE INVENTION

The plunger lift assembly and method for using such an assembly is disclosed in commonly assigned U.S. Pat. Nos. 6,467,541 and 6,719,060, which are incorporated herein by reference. For purposes of background and context, portions of the above patents, which have been incorporated by reference, will be repeated in this application.

There are many different techniques for artificially lifting formation liquids from hydrocarbon wells. Reciprocating sucker rod pumps are the most commonly used because they are the most cost effective, all things considered, over a wide variety of applications. Other types of artificial lift include electrically driven down hole pumps, hydraulic pumps, rotating rod pumps, free pistons or plunger lifts and several varieties of gas lift. These alternate types of artificial lift are more cost effective than sucker rod pumps in the niches or applications where they have become popular. One of these alternative types of artificial lift is known as a plunger lift, which is basically a free piston that moves upwardly in the well to move formation liquids to the surface. Typically, plunger lifts are used in gas wells that are loading up with formation liquids thereby reducing the amount of gas flow. For purposes of this application a free piston should be understood to be a piston that is not attached to a reciprocating member, but rather relies on fluids and fluid pressure to provide lift the piston components.

Gas wells reach their economic limit for a variety of reasons. A very common reason is the gas production declines to a point where the formation liquids are not readily moved up the production string to the surface. The fluid dynamics of two phase upward flow in a well is a complicated affair and most engineering equations thought to predict flow are only rough estimates of what is actually occurring. One reason is the changing relation of the liquid and of the gas flowing upwardly in the well. At times of more-or-less constant flow, the liquid acts as an upwardly moving film on the inside of the flow string while the gas flows in a central path on the inside of the liquid film. The gas flows much faster than the liquid film. When the volume of gas flow slows down below some critical values, or stops, the liquid runs down the inside of the flow string and accumulates in the bottom of the well.

If sufficient liquid accumulates in the bottom of the well, the well is no longer able to flow because the pressure in the reservoir is not able to start flowing against the pressure of the liquid column. When such conditions occur, the well is said to have loaded up and died. Years ago, gas wells were plugged much more quickly than today because it was not economic to artificially lift small quantities of liquid from a gas well. However, at relatively high gas prices, it is economic to keep old gas wells on production. It has gradually been realized that gas wells have a life cycle that includes an old age segment where a variety of techniques are used to keep liquids flowing upwardly in the well and thereby prevent the well from loading up and dying.

There are many techniques for keeping old gas wells flowing and the appropriate one depends on where the well is in its life cycle. For example, a first technique is to drop soap sticks into the well. The soap sticks and some agitation cause the liquids to foam. The well is then exposed to the atmosphere and a great deal of foamed liquid is discharged from the well. Later in its life cycle, when soaping the well has become much less effective, a string of 1" or 1.5" tubing is run inside the production string. The idea is that the upward velocity in the small tubing string is much higher which keeps the liquid moving upwardly in the well to the surface. A rule of thumb is that wells producing enough gas to have an upward velocity in excess of 10'/second will stay unloaded. Wells where the upward velocity is less than 5'/second will always load up and die.

As some stage in the life of a gas well, these techniques no longer work and the only approach left to keep the well on production is to artificially lift the liquid with a pump of some description. The logical and time tested technique is to pump the accumulated liquid up to the tubing string with a sucker rod pump and allow produced gas to flow up the annulus between the tubing string and the casing string. This is normally not practical in a 2⅞" tubingless completion unless one tries to use hollow rods and pump up the rods, which normally doesn't work very well or very long. Even then, it is not long before the rods cut a hole in the 2⅞" string and the well is lost. In addition, sucker rod pumps require a large initial capital outlay and either require electrical service or elaborate equipment to restart the engine.

Free pistons or plunger lifts are another common type of artificial pumping system to raise liquid from a well that produces a substantial quantity of gas. Conventional plunger lift systems comprise a piston that is dropped into the well by stopping upward flow in the well, as by closing the wing valve on the well head. The piston is often called a free piston because it is not attached to a sucker rod string or other mechanism to pull the piston to the surface. When the piston reaches the bottom of the well, it falls into and passes through the liquid in the bottom of the well and ultimately into contact with a bumper spring, normally seated in a collar or resting on a collar stop. The wing valve is opened and gas flowing into the well pushes the piston upwardly toward the surface, and thereby pushes liquid on top of the piston to the surface. Although plunger lifts are commonly used devices, there is as much art as science to their operation.

A major disadvantage of conventional plunger lifts is the well must be shut in so the piston is able to fall to the bottom of the well. Because wells in need of artificial lifting are susceptible to being easily killed, stopping flow in the well has a number of serious effects. Most importantly, the liquid on the inside of the production string falls to the bottom of the well, or is pushed downwardly by the falling piston. This is the last thing that is desired because it is the reason that wells load up and die. In response to the desire to keep the well flowing when a plunger lift piston is dropped into the well, attempts have been made to provide valved bypasses through the piston which open and close at appropriate times. Such devices are to date quite intricate and these attempts have so far failed to gain wide acceptance.

A more recent development is of multi-part free piston assemblies which may be dropped into a well while formation contents are flowing upwardly in the well as shown in U.S. Pat. Nos. 6,148,923, 6,209,637 6,467,541, 6,719,060, and 7,383,878. In the most recent development, as reflected in this patent application, the free piston assembly includes a flow restriction member, typically in the form a ball, that is releasably retained by or seated in a sleeve member such that the flow restriction member will not be released from the sleeve member solely by the force of gravity. As will be more fully appreciated by the description of the invention below, if the flow restriction member prematurely releases from the sleeve member, such as by a sudden decrease in formation fluid pressure ("lift"), the sleeve and flow restriction member will separately drop in the well until at some point they are reunited and begin the upward journey once again. In many instances the separate free piston components are not reunited until they reach the bottom of the well at which time the process starts once again, thus losing valuable time and exposing the well to potential fluid pressures that may cause the well to stop flowing.

In some of the prior art devices utilizing such a separate free piston assembly the components are latched together before beginning the lift portion of the process. Such latching presents problems that are overcome by the assembly of this invention. Specifically, the latching requires that the flow restriction member be captured by a mechanical structure that holds the flow restriction member in place during the lift. Such latching can be conveniently implemented at the bottom of the well where other structure is available to prevent movement of the flow restriction member while it is being latched, but just the opposite is true if the joinder of the flow restriction member and the sleeve member are being joined at a location above the bottom of the well. In such instances, the latching mechanism can actually interfere with the seating of the flow restriction member in the sleeve member and may result in the unwanted loss of time in joining the free piston members. The latching structure also tends to be cumbersome to install and frequently wears out prior to the useful life of the free piston assembly being completed.

SUMMARY OF THE INVENTION

In this invention, an improved free piston assembly is used as part of a plunger lift assembly. In some preferred embodiments, the improved free piston assembly includes a sleeve member having an inner surface that is contoured such that a seat is provided for a flow restriction member. The flow restriction member s typically in the shape of sphere (referred to generically in some instances as a "ball") and is held in the seat in the sleeve by formation fluid forces in the well, and is retained in the sleeve when not seated by retention means that are functionally effective to overcome the force of gravity seeking to displace the flow restriction member, but at the same time are designed to release the flow restriction member when a rod member of the plunger lift assembly contacts the flow restriction member.

During the operation of the improved free piston assembly of this invention one of the techniques used to hold the sleeve member at the surface involves the flow of formation contents directed upwardly around and/or through and opening in the sleeve member that comprises part of the piston to produce a pressure drop across the sleeve sufficient to hold the sleeve in the wellhead and offset gravity. The sleeve is released by momentarily interrupting flow from the well, as by the use of a motorized wing valve on the well head. As soon as flow is interrupted, the pressure drop across the sleeve disappears and the sleeve falls into the well.

In one preferred embodiment of this invention the flow restriction device is held in the sleeve member, when it is not seated based on formation pressure, by spring loaded retention means. In this embodiment of the invention, while the flow restriction device is seated in the portion of the sleeve member sized and configured to receive the flow restriction device, the spring loaded retention means are not physically in contact with the flow restriction device. Such an arrangement permits some axial movement of the flow restriction device before being engaged by the retention means. This is in contrast to prior art devices that require latching and do not permit any significant axial movement of the flow restriction member.

In another preferred embodiment of this invention the retention means comprises a raised lip on the interior surface of the sleeve member, the raised lip being located such that when the flow restriction member is seated in the portion of the sleeve member designed to receive the flow restriction member there is no physical contact between the flow restriction member and the raised lip thus permitting some axial movement of the flow restriction member before being engaged by the restriction means. In this preferred embodiment, if the flow restriction member is unseated because of a drop in pressure it will be retained in the sleeve member by the raised lip retention means. As will be described more fully hereinafter, the raised lip retention means is sized such that it can overcome the force of gravity pushing the flow restriction member toward the bottom of the well. The raised lip retention means can be either a continuous lip around the interior circumference of the sleeve member or can be a discontinuous lip. In the most preferred embodiment, the configuration and size of the raised lip retention means must be such that the force of gravity on the flow restriction member cannot overcome the retention force applied by the retention means, unless the force of gravity is supplemented by mechanical displacement means such as a mechanical rod extending through the sleeve from the catcher assembly of the plunger assembly.

In a variation of the embodiment of this invention that includes either a continuous or discontinuous raised lip on the interior surface of the sleeve member, the raised lip is configured such that the force required for the flow restriction device to enter the sleeve member is less than the force required to displace the flow restriction device from the sleeve member.

In another embodiment of this invention the flow restriction device is held in the sleeve member by a retention sleeve mounted in one portion the sleeve member and sized to receive and hold the flow restriction member. In this embodiment of the invention the flow restriction member (sometimes referred to as a "flow restriction device") is held in the sleeve by frictional forces supplied by the retention sleeve. Like the previous embodiments, in this embodiment the flow restriction device is held in place until the force of gravity is supplemented by mechanical separation means.

During the operation of the improved free piston assembly of this invention one of the techniques used to hold the sleeve member at the surface involves the flow of formation contents directed upwardly around and/or through the sleeve member that comprises part of the piston to produce a pressure drop across the sleeve sufficient to hold the sleeve in the wellhead and offset gravity. The sleeve is released by momentarily interrupting flow from the well, as by the use of a motorized wing valve on the well head. As soon as flow is interrupted, the pressure drop across the sleeve disappears and the sleeve falls into the well.

In another aspect of the plunger lift assembly that is used in combination with the improved free piston assembly of this invention, a sensor is used to detect liquid flow, as opposed to gas flow and a parameter or value is obtained that is proportional to the amount of liquid being ejected from the well by the free piston. If the amount of liquid is smaller than desired, part of the multipart piston is retained in the well head a little longer time than previously. If the amount of liquid is larger than desired, part of the multipart piston is retained in the well head a little shorter time than previously. It is desired to retrieve a small quantity of liquid on each trip of the free piston, typically on the order of ⅛ to ½ barrel per trip.

DETAILED DESCRIPTION OF THE PREFERRED EMBODIMENTS

Figure 1:
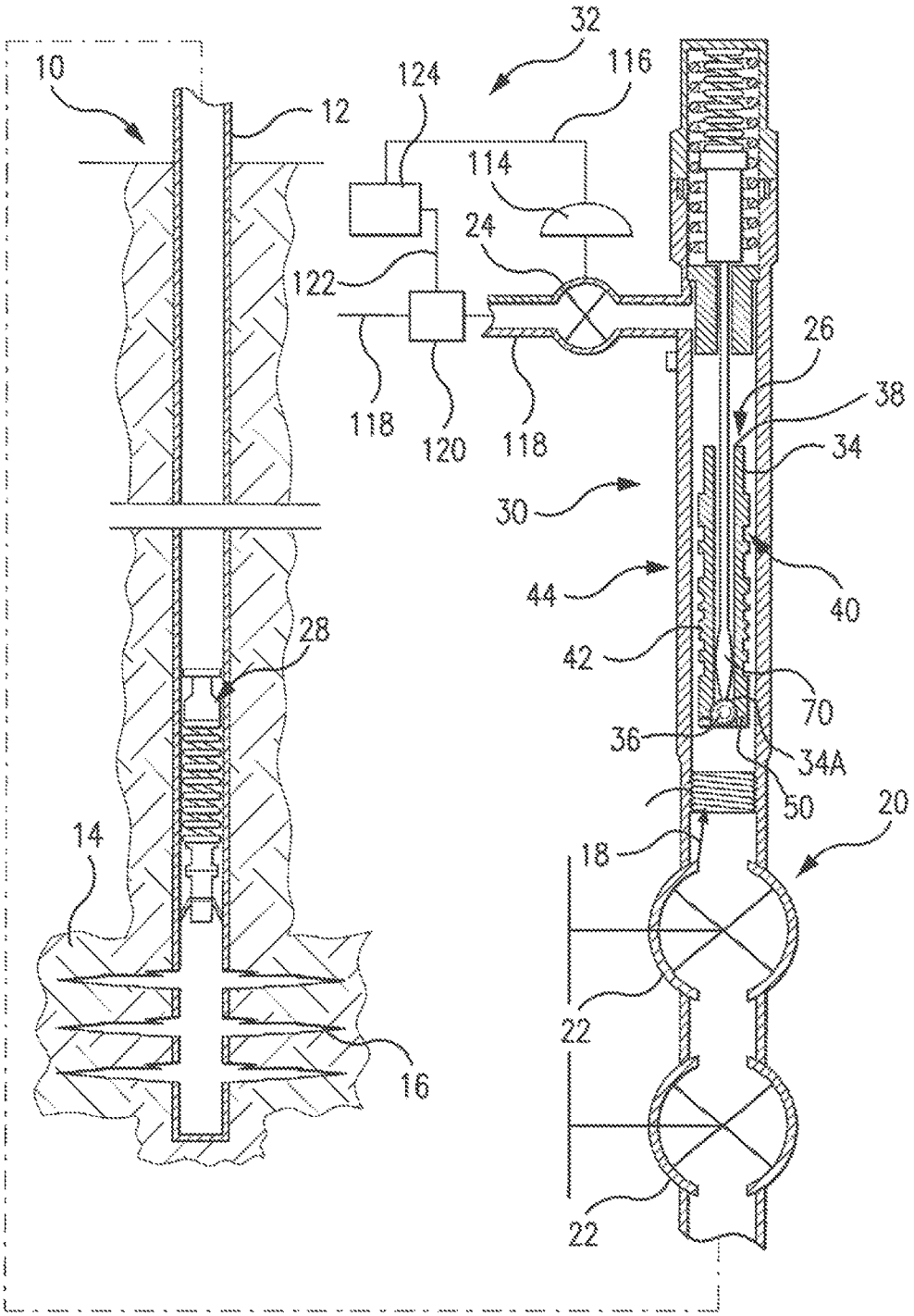
FIG. 1 is a schematic view of a well equipped with a plunger lift system that includes one embodiment of the improved free piston assembly of this invention, certain parts being broken away for clarity of illustration.
Figure 2:
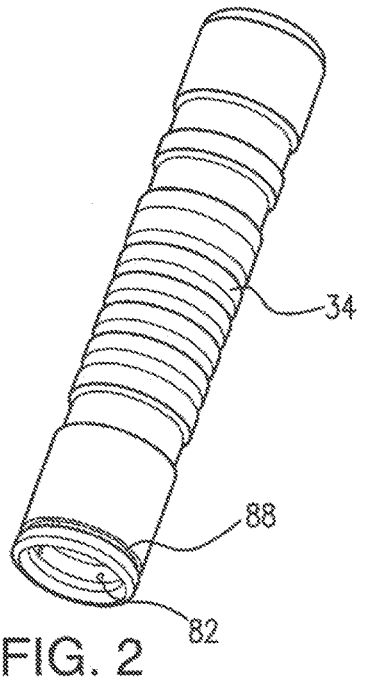
FIG. 2 is a schematic view of the sleeve member of this invention with the retention assembly in place but without the flow restriction member.
Figure 3:
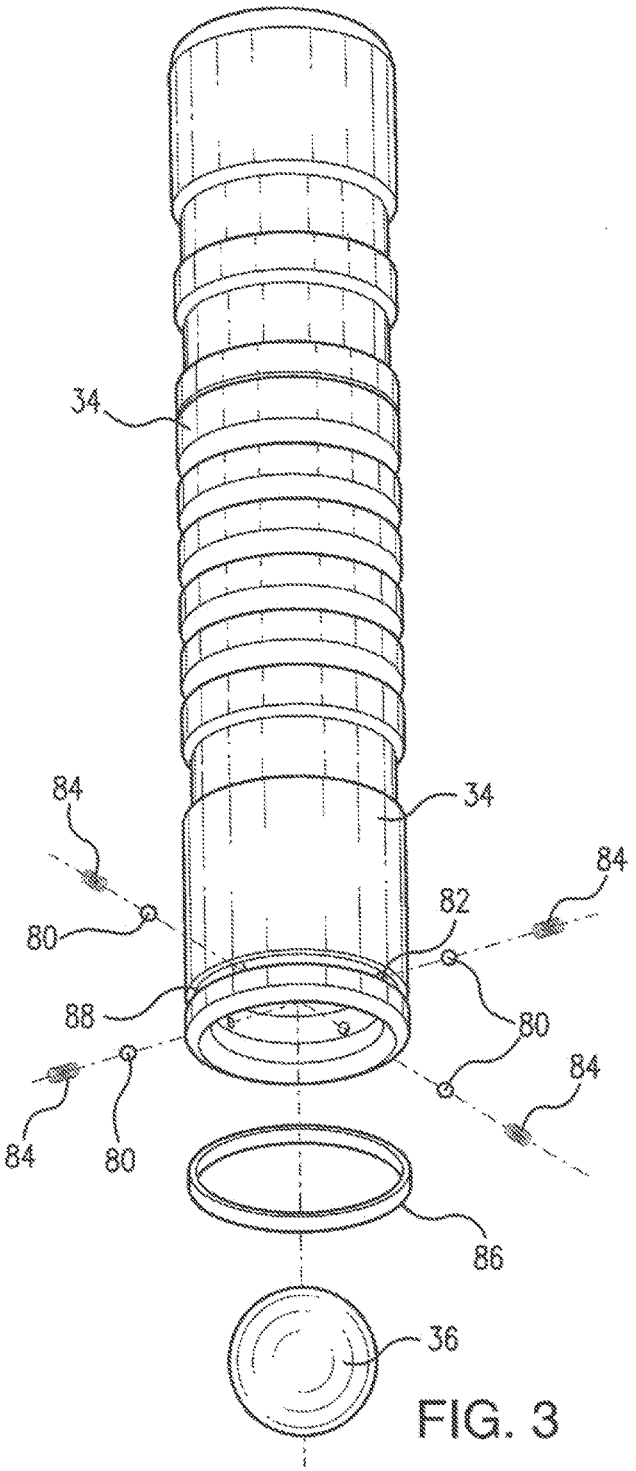
FIG. 3 is cross sectional view of the sleeve member, flow restriction member and spring loaded retention means embodiment of this invention.
Figure 4:
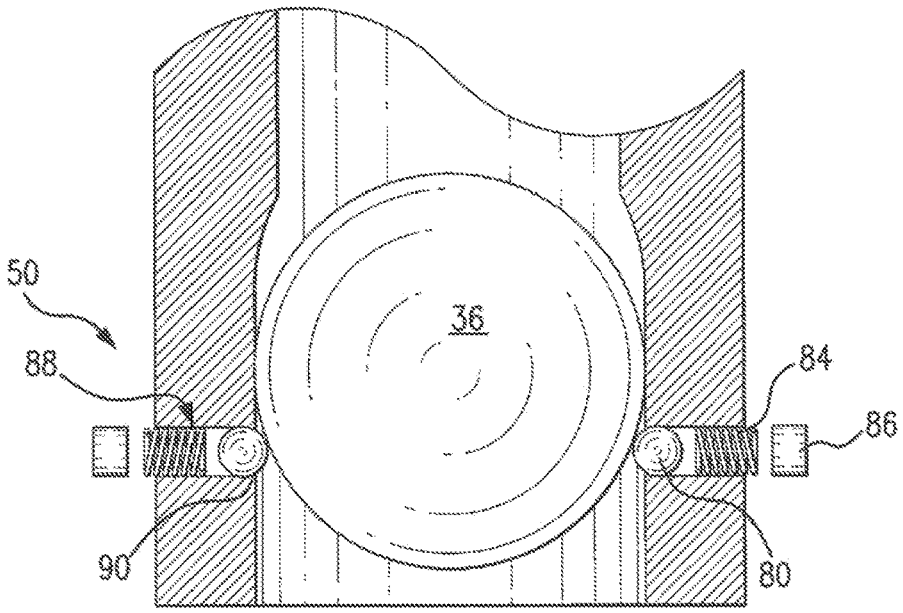
FIG. 4 is an exploded cross sectional view of the sleeve member, flow restriction member and spring loaded retention assembly with the flow restriction member being held in place by the spring loaded retention assembly.
Figure 5:
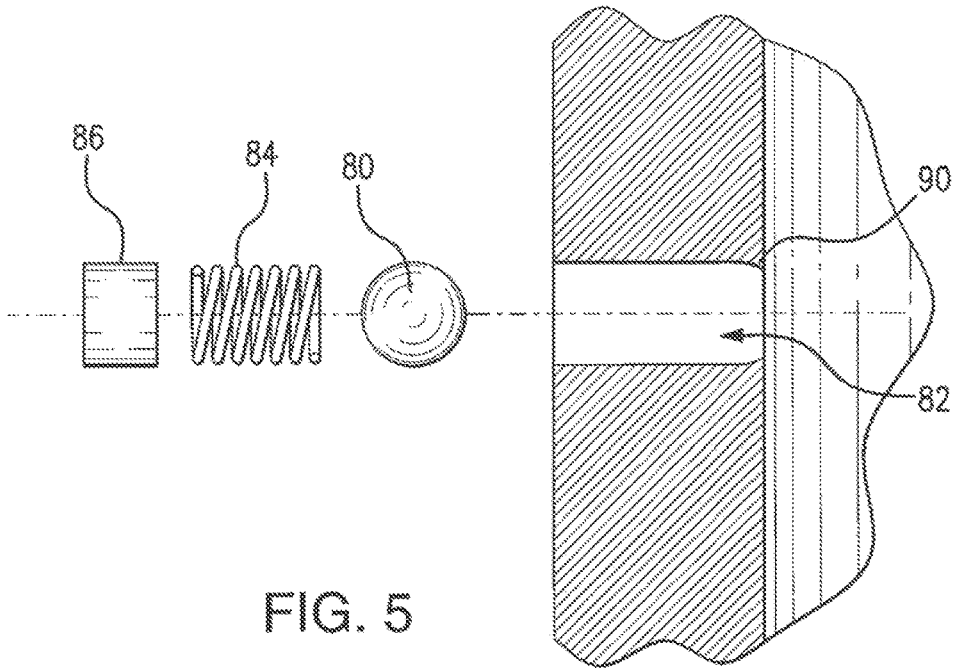
FIG. 5 is an exploded cross sectional view of the retention assembly of FIG. 4.

The multipart plunger embodiments shown in commonly assigned U.S. Pat. No. 6,467,541 has proven to be quite satisfactory for a wide range of applications where gas wells produce sufficient liquid that slows down gas production and ultimately kills the well. Experience and analysis resulted in two improvements being made in the operation of a multipart plunger. These improvements are disclosed in commonly assigned U.S. Pat. No. 6,719,060 and are described with more particularity below and in the specification of the U.S. Pat. No. 6,719,060.

In one embodiment of the plunger lift assembly used in combination with the improved free piston assembly of this invention, the technique used to separate and hold the plunger at the surface employs moving parts to receive and cushion the impact of the plunger as it arrives at the surface but employ no moving parts to hold the plunger in the well head. A separator rod is provided which the plunger sleeve slides over, thereby dislodging the flow restriction member and causing it to fall into the well. Flow from the well passes around and/or through the separator rod and the opening to the sleeve member, also referred to as the plunger sleeve. The separator rod and plunger sleeve include cooperating sections that produce a pressure drop sufficient to hold the plunger sleeve in the well head against the force of gravity. When flow through the well head is insufficient to hold the plunger sleeve against the force of gravity, the plunger sleeve falls into the well, couples with the flow restriction member at or near the bottom of the well and then moves upwardly to produce a quantity of formation liquid thereby unloading the well. Typically, the plunger sleeve is dropped into the well in response to closing of a valve at the surface that interrupts flow thereby momentarily reducing gas flow at the surface and substantially eliminating any pressure drop across the plunger sleeve. Various aspects of the separator rod and housing for the separator rod are shown and described in U.S. Pat. No. 6,719,060, which has been previously incorporated by reference.

An important advantage of the separator rod used in combination with the improved free piston assembly of this invention is the plunger sleeve is dropped by momentarily shutting a valve controlling flow from the well. This allows operation of the plunger lift without using natural gas as a power source for a holding device thereby eliminating the venting of methane to the atmosphere. It also eliminates a holding device which includes moving parts subject to malfunction or failure.

Major gas producing companies that operate large numbers of gas wells have gained considerable experience in keeping older gas wells flowing. Many such companies use large numbers of plunger lifts and have devised sophisticated computer programs to determine when to drop conventional one-piece plungers into a well. It will be recollected that one-piece plungers are typically held at the surface until production falls off, whereupon the well is shut in, the plunger is released and the well remains shut in for a long enough time for the plunger to fall to the bottom of the well. The flow control valve is then opened and the well produces enough formation content to drive the plunger to the surface, producing liquid along with gas and thereby unloading the well. The computer programs used to operate conventional one-piece plunger lift systems act in response to a wide variety of input information, e.g. flowing well head pressure or flow line pressure which are either the same or very close to the same, gas volume, pressure on the casing as opposed to pressure of gas flowing in the tubing and previous plunger speed as an indication of the liquid being lifted.

Although they can be made to work satisfactorily with multipart plungers, these conventional programs measure the wrong things to drop a multipart plunger sleeve into a well on an optimum basis. An ideal cycle for a multipart plunger is to lift a small quantity of liquid on each plunger trip. It is not desirable to lift no liquid because the plunger takes a beating when it enters the well head with no liquid in front of it—the piston velocity is too high and the spring assemblies in the well head take too much punishment. More importantly, if no liquid is being lifted, it is quite likely there is no liquid in the bottom of the well. When this happens, there is likely considerable damage done to the bumper assembly at the bottom of the well as may be imagined by considering the damage potential of a metal article weighing a few pounds falling at terminal velocity. When there is no liquid being lifted, the plunger should be dropped less frequently.

Conversely, if the plunger is lifting too large a quantity of liquid on each cycle, the productivity of the well is being unduly restricted. If the quantity of liquid becomes too large, there is a risk that plunger will not cycle and the well will be dead. When the quantity of liquid becomes larger than a small selected value, the plunger should be dropped more frequently. Thus, there is an ideal amount of liquid to be raised on each cycle and it is surprisingly small, something on the order of ¼ to ⅛ barrel, depending on the flowing bottom hole pressure of the well and the flow line pressure the well is producing against. In normal situations, a preferred amount being lifted on each cycle of the plunger is on the order of about ⅙ barrel. Thus, by measuring what is important to the operation of a multipart piston of a plunger lift, improved operations result.

Referring to FIGS. 1-10, a hydrocarbon well 10 comprises a production string 12 extending into the earth in communication with a subterranean hydrocarbon bearing formation 14. The production string 12 is typically a conventional tubing string made up of joints of tubing that are threaded together. Although the production string 12 may be inside a casing string (not shown), it is illustrated as cemented in the earth. The formation 14 communicates with the inside of the production string 12 through perforations 16. As will be more fully apparent hereinafter, a plunger lift assembly 18 is used to lift oil, condensate or water from the bottom of the well 10 which may be classified as either an oil well or a gas well.

In a typical application of this invention, the well 10 is a gas well that produces some formation liquid. In an earlier stage of the productive life of the well 10, there is sufficient gas being produced to deliver the formation liquids to the surface. The well 10 is equipped with a conventional well head assembly 20 comprising a pair of master valves 22 and a wing valve 24 delivering produced formation products to a surface facility for separating, measuring and treating the produced products.

The plunger lift 18 of this invention comprises, as major components, a free piston 26, a lower bumper assembly 28 near the producing formation 14, a catcher assembly 30 and an assembly 32 for controlling the cycle time of the piston 26. The free piston 26 is of multipart design and includes a sleeve 34 (sometimes referred to as the "sleeve member") and a flow restriction member 36 which is preferably a sphere as shown in U.S. Pat. No. 6,467,541, the disclosure of which has been previously incorporated herein by reference. The free piston 26 also includes retention means 50 for retaining the flow restriction member 36 in the interior of the sleeve 34 by supplying a force sufficient to overcome the force of gravity on said flow retention member 36. For purposes of this invention, the preferred flow restriction member 36 is a sphere and therefore in some instances the terms are used interchangeably. It should, however, be understood that other embodiments of flow restriction members may be equally viable in the improved free piston assembly of this invention.

The sleeve 34 is generally cylindrical having an opening that forms an interior flow passage 38 and a seal arrangement 40 to minimize liquid on the outside of the sleeve 34 from bypassing around the exterior of the sleeve 34. The seal arrangement 40 may be of any suitable type, such as wire brush wound around the sleeve 34 providing a multiplicity of bristles or the like or may comprise a series of simple grooves or indentations 42. The grooves 42 are functionally effective because they create a turbulent zone between the sleeve 34 and the inside of the production string 12 thereby restricting liquid flow on the outside of the sleeve 34. In certain embodiments of this invention, sleeve 34 also includes an interior surface 34A against which the flow restriction member 36 can seat when it is being retained in the interior opening to sleeve 34. During the lifting operation associated with the function of the free piston of this invention the flow restriction member 36 is maintained in its seated position because of formation pressure. If pressure to the flow restriction member is interrupted the force of gravity will unseat the flow restriction member and potentially cause it to exit from the sleeve 34. To prevent the flow restriction member from prematurely exiting the sleeve 34 the retention means 50 of this invention are used.

As will be more fully apparent hereinafter, the flow restriction member 36, especially when configured as a sphere, is first dropped into the well 10, followed by the sleeve 34. The sphere 36 and sleeve 34 accordingly fall separately and independently into the well 10, usually while the well 10 is producing gas and liquid up the production string 12 and through the well head assembly 20. When the sphere 36 and sleeve 34 reach the bottom of the well, they impact the lower bumper assembly 28 in preparation for jointly moving upwardly. The lower bumper assembly 28 may be of any suitable design, one of which is illustrated in U.S. Pat. No. 6,209,637 and basically acts to cushion the impact of the sphere 36 and sleeve 34 when they arrive at the bottom of the well 10.

An important feature of the plunger lift assembly is the catcher assembly 30 which has several functions, i.e. separating the sphere 36 from the sleeve 34, retaining the sleeve 34 in the assembly 30 for a period of time and then dropping the sleeve 34 into the well 10. The catcher assembly 30 is more fully described in U.S. Pat. No. 6,719,060 which has been previously incorporated by reference. The catcher assembly 30 comprises an outer housing or catch tube 44 which provides an outlet for formation products and a shoulder for stopping the upward movement of the sleeve 34.

Inside the housing 44 is a separation rod assembly for cushioning the impact of the sleeve 34, and to some extent of the ball 36, when the free piston 26 reaches its upper limit of its travel. The sleeve 34 ultimately passes onto the lower end of the separator rod 70 thereby overcoming the retaining force of the retention means 50 and dislodging the ball 36 and allowing it to fall immediately back into the production string 12.

Figure 6:
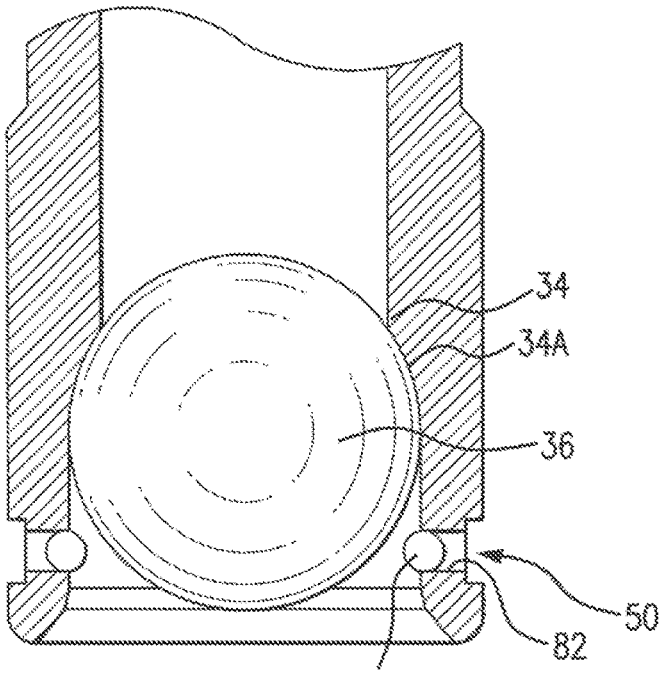
FIG. 6 is a cross sectional view of the sleeve member, flow restriction member, and spring loaded retention means of this invention showing the flow restriction member seated in the sleeve member and being axially removed from the retention means.
Figure 7:
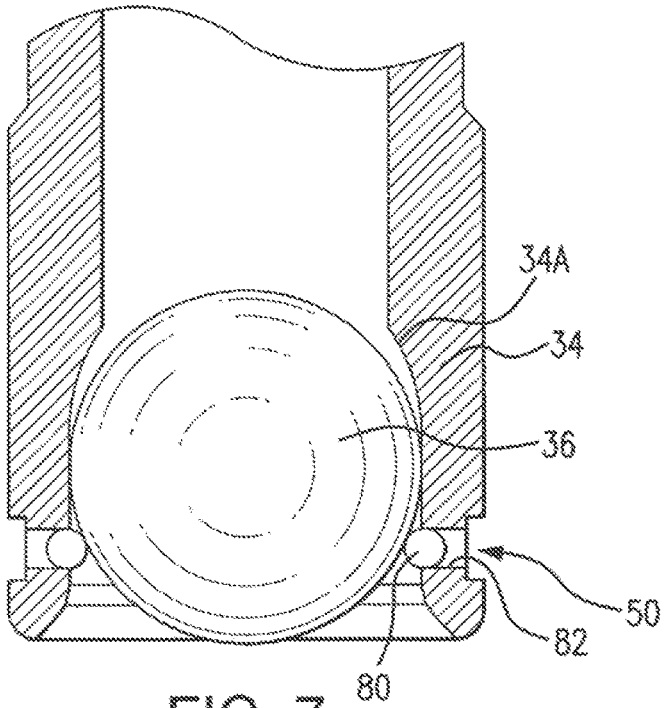
FIG. 7 is the same cross sectional view as shown by FIG. 6 but with the flow restriction member being unseated and being retained in the sleeve member by spring loaded retention means.

An important feature of this invention is that the free piston assembly 26 includes retention means 50 to hold the flow restriction member 36 in the sleeve 34 to overcome the force of gravity placed on such flow restriction member. As has been previously described, retention means 50 can take a number of design forms, however, the preferred design is a plurality of spring loaded retractable members 80 used to retain the flow restriction device in the sleeve 34. The retractable members 80 are sometimes in the form and size of ball bearings. In this embodiment of the invention the spring loaded retractable members 80 are not in physical contact with the flow restriction device 36 when member 36 is seated on surface 34A. Such a configuration permits axial movement of the flow restriction member 36 between the seat 34A and the retention member 50. The axial movement of this embodiment is illustrated in FIGS. 6 and 7.

In the spring loaded embodiment of the retention means a plurality of ball shaped retractable pressure members 80 are configured to protrude inwardly from apertures 82 communicating with the inner surface of the sleeve member 34. The inward bias or pressure is supplied by spring means 84 contacting the outer surface of each of the ball shaped retractable pressure members 80. The spring means 84 are held in place by a retaining ring 86 that is sized to fit into a groove 88 in the exterior surface of the sleeve 34. The retaining ring 86 may be made from any of a variety of well known materials for use in downhole applications, but specifically include elastomeric materials, soft metals, ceramics, plastics, rubber and other forms of polymeric material.

As can be more clearly seen in FIGS. 2-7, in this preferred embodiment of the invention a groove 88 is cut into the exterior surface of sleeve 34. A series of apertures 82 are cut into the lower surface of the groove such that the apertures 82 communicate directly with the interior surface of the sleeve 34. The apertures 82 are forming such that the diameter of the portion of each aperture closest to the interior of the sleeve is smaller than the diameter of the retractable ball member (see FIGS. 4 and 5), thus provide a seat 90 for the retractable pressure members 80 and prevent the pressure members 80 from falling into the interior of the sleeve member 34. The pressure members 80 are biased toward the interior of the sleeve member 34 by spring means 84, which can be spiral springs or leaf springs. The retractable ball members 80 are movable between a fully biased position in which at least a portion of the ball member 80 protrudes into the interior of the sleeve member to a retracted position in which the interior most surface of the ball member 80 is even with the interior surface of the sleeve member and does not provide a retaining force on the flow restriction member and does not prevent the flow restriction member from escaping from the sleeve member. The spring means 84 are in contact with the exterior surface of the retractable pressure members 80 such that the pressure members 80 protrude into the interior of the sleeve member in order to prevent the flow restriction member 36 from escaping the sleeve member 34 based on the force of gravity. The spring means 84 and pressure members 80 are mounted in the apertures 82 in the groove 88, and in turn are held in place by a retention member 86, typically in the form of a retention ring.

In practice, the groove 88 for the retention means 50 is located on the sleeve 34 at a position such as shown in FIGS. 2-7. As can be seen, a substantial portion of the entire flow restriction member 36 is held inside the sleeve member 34 although the only requirement is that the flow restriction member 36, regardless of its shape, be maintained in the sleeve member until physically released by the separation rod or other form of mechanical releasing mechanism.

Figure 8:
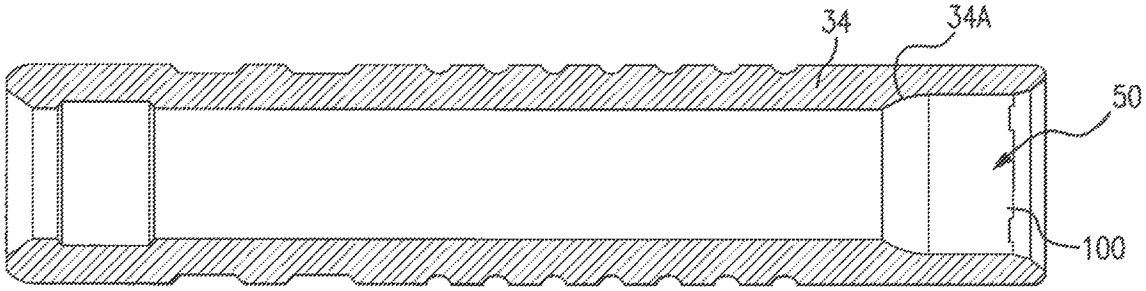
FIG. 8 is a cross sectional view of one embodiment of the free piston assembly of this invention including the sleeve member and the retention member in the form of a raised lip.
Figure 8A:
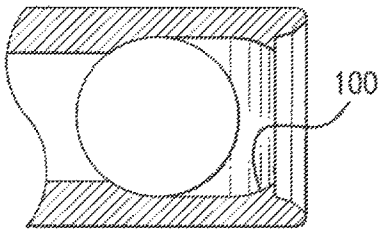
FIG. 8A is a cross sectional view of a portion of the embodiment of the free piston assembly of FIG. 8 showing the sleeve member with the flow restriction device seated and the retention means spaced apart from any physical contact with the flow restriction device.
Figure 8B:
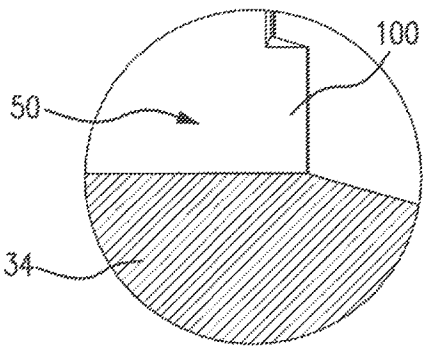
FIG. 8B is a cross sectional view of one embodiment of e raised lip retention means of this invention.
Figure 8C:
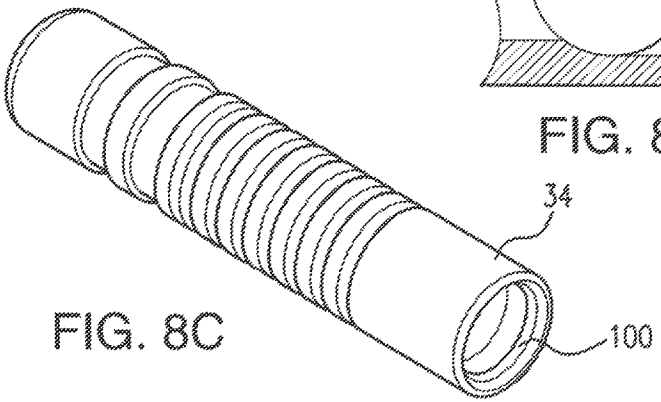
FIG. 8C is a schematic view of the sleeve member of this invention with the raised lip retention means embodiment of FIG. 8B.

In another preferred embodiment of the invention the retention means 50 are in the form of a raised lip 100 that provides sufficient retention force to overcome the force of gravity and keep the flow retention member in the sleeve unless the gravitational force is supplemented by a mechanical force in the form of separation rod 70. In this embodiment of the retention means of this invention, as shown more particularly in FIGS. 8, 8A, 8B and 8C, the raised lip 100 does not physically contact the flow restriction member 36 but in fact permits some axial movement of flow restriction member 36 prior to stopping its downward movement. Raised lip 100 may take a number of forms, including, but not limited to a semi-circumferential notched lip (see FIGS. 8, 8B, and 8C) or a different configuration such as shown in FIG. 8A. The raised lip 100 may be circumferential or partially circumferential and may be of any shape of configuration that is functionally effective to retain flow restriction member 36 by overcoming the force of gravity on member 36 when it is unseated.

Figure 9:
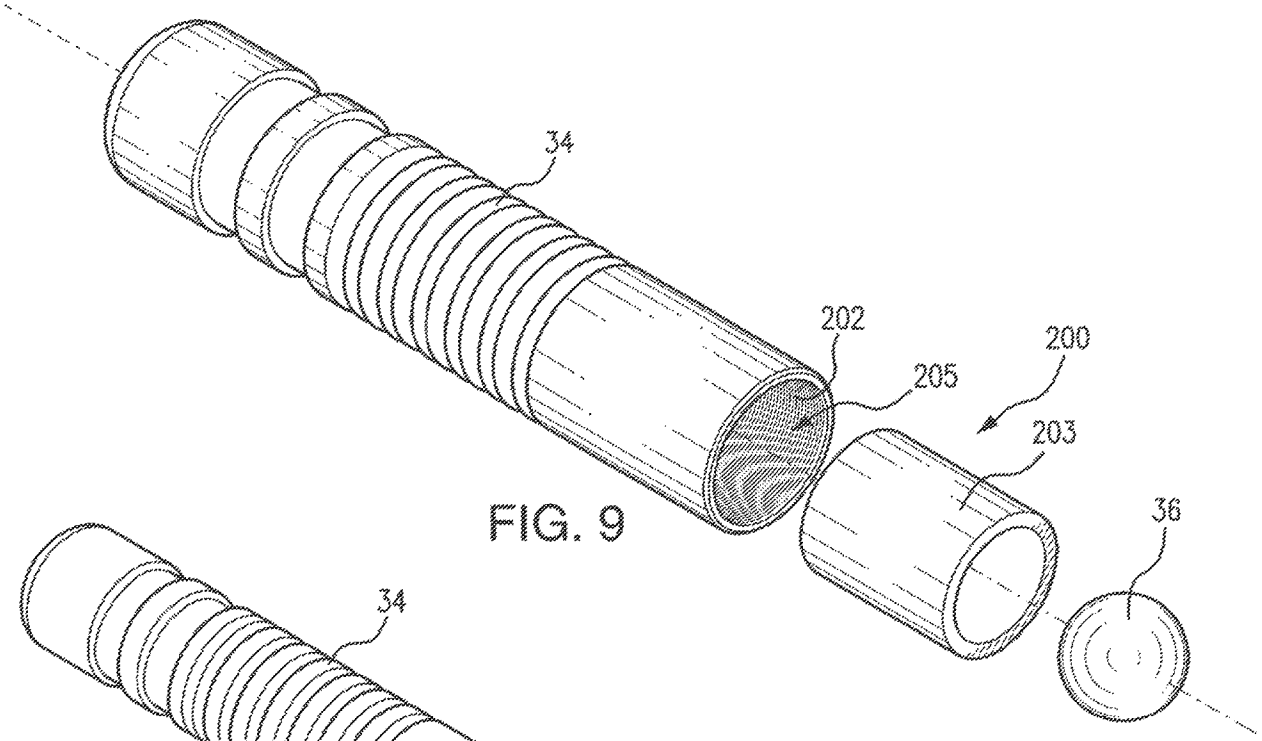
FIG. 9 is an exploded schematic view of an alternative embodiment of the retention means of this invention showing a retention sleeve as the retention means.
Figure 9A:
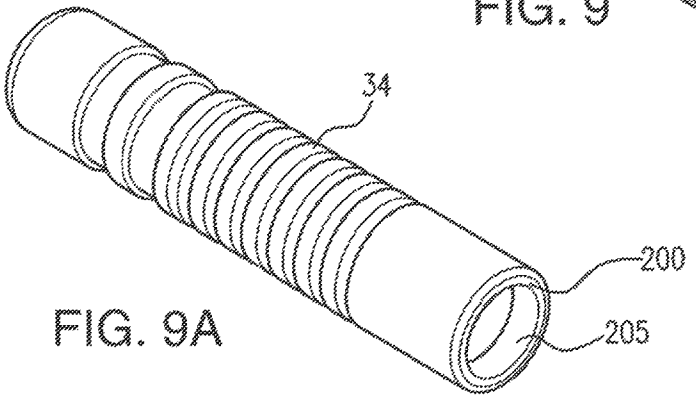
FIG. 9A is a schematic view of the sleeve member of this invention with the retention sleeve embodiment of FIG. 9.
Figure 10:
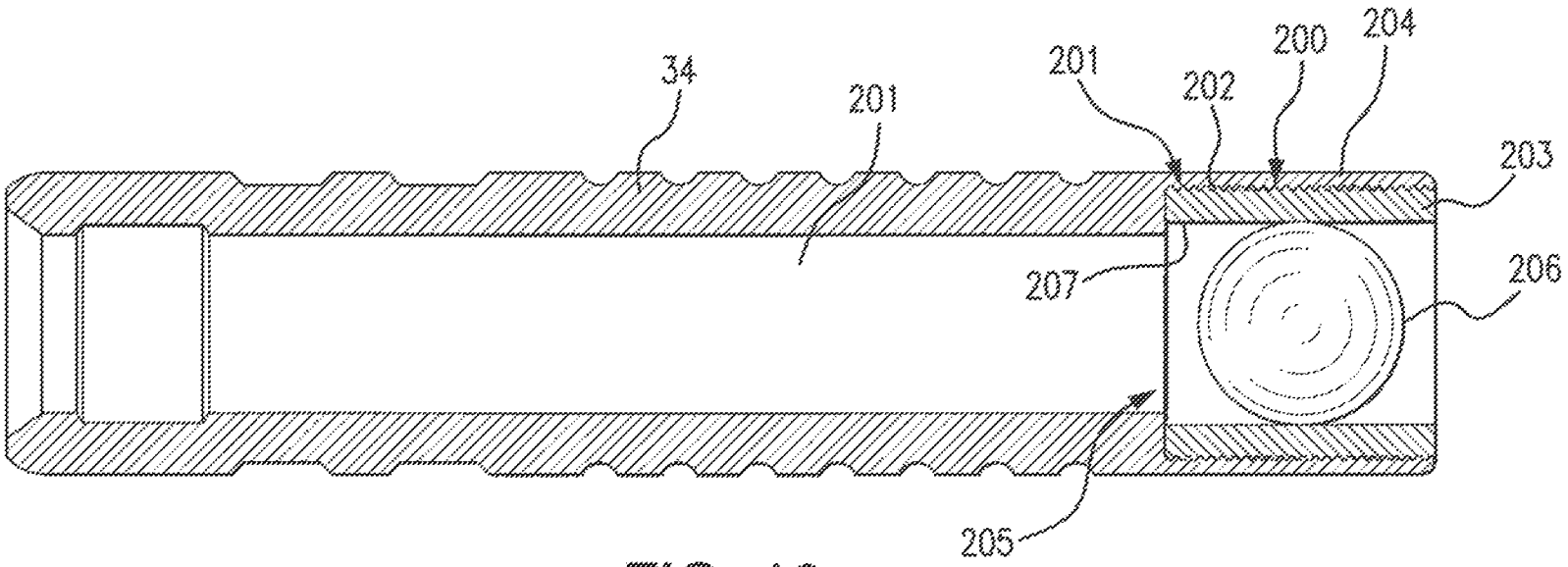
FIG. 10 is a cross sectional view of the retention sleeve embodiment of FIG. 9 showing the flow restriction member being retained by a retention sleeve.

In yet another embodiment of this invention, as illustrated by FIGS. 9-10, a retention sleeve 200 is mounted in an interior section of sleeve 34. The actually mounting of the retention sleeve 200 in sleeve 34 can be done by conventional means that are within the knowledge and understanding of a person of ordinary skill in the art. By way of example, the retention sleeve 200 can be fixed to the interior surface 201 of sleeve 34 by an adhesive or, as illustrated by FIG. 10, by a series of protrusions 202 from sleeve 34 that protrude into the exterior surface 203 of sleeve 200 to prevent movement of sleeve 200 once it has been installed.

As shown in FIG. 10, the retention sleeve 200 fits into and is mounted in a section 204 of sleeve 34, but no clear seat for flow restriction member 36 is provided. However, as can be readily appreciated, if the formation pressure moves the flow restriction member 36 in an upward axial direction, the flow restriction member 36 will seat in the opening to the second portion 205 of sleeve 34. A particular advantage of the retention sleeve 200 embodiment of retention means 50 is the ability of the flow restriction device 36 to seal the opening of sleeve 34 as soon as the flow restriction device 36 is fully inserted into the retention sleeve 200, regardless of where in sleeve 200 the flow restriction device 36 is placed. In practice, the flow restriction device 36 is held in sleeve 200 by frictional forces between the exterior surface 206 of the flow restriction device and the interior surface 207 of the retention sleeve.

The retention sleeve can be manufactured from any of a well know variety of materials including elastomers, plastics, rubber, soft metals, other such materials, and combinations thereof, all of which are well known in the oil and gas exploration industry. Particular materials that will be functionally effective as components of sleeve 200 will depend on a number of factors such as the types of fluids that are encountered in the well, the temperatures encountered in the well and other well-related variables.

Importantly, one of the primary differences between the prior art mechanical latching mechanisms and the retention means embodiments of this invention is the axial movement of the flow restriction member that is permitted by the retention means of this invention, whether in the form of spring loaded ball members, a raised lip, or a retention sleeve.

In the preferred embodiments of this invention the retention ring is made from a number of materials that are well known to persons of ordinary skill in the art and include chrome steel, titanium, stainless steel, ceramic, tungsten carbide, silicone nitrate, plastic, and rubber or any other functionally effective elastomeric. On the other hand, the sleeve member and flow retention member are made from materials selected from the group consisting of stainless steel, chrome steel, cobalt, ceramic (zirconium), tungsten carbide, silicon nitride, and titanium alloys. In the most preferred embodiments of this invention the sleeve member and flow retention member are made from one or more of the materials list hereinabove and having a density of less than about 0.25 pounds per cubic inch and a tensile strength of at least 90,000 psi.

Referring to FIG. 1, the piston sleeve 34 is dropped into the production string 12 simply by momentarily closing the wing valve 24. This may be automated by providing a motor operator 114 and controlling the operator 114 by an electrical signal delivered through a wire 116. Although any suitable controller may be used to cycle the plunger lift of this invention, a preferred technique is to measure or sense liquid delivered through a flow line 118 leading from the wellhead 20 and momentarily close the valve 24 in response to a parameter related to the amount of liquid flowing in the flow line 118.

Operation of the plunger lift of this invention should now be understood. During upward movement of the piston 26 toward the well head 20, production through the wing valve 24 is mainly dry gas. As the piston 26 approaches the well head, there is often a small slug or batch of liquid that passes through the wing valve 24 which may cause the meter 120 or a detector (not shown) to detect the arrival of a liquid slug at the surface. If the amount of liquid is very small, it can be readily identified and disregarded by the controller 124. As the piston 26 nears the well head 20, it pushes a quantity of liquid above it through the well head and the wing valve 24 to be measured or sensed by the meter 120 or a detector. If the plunger lift and improved free piston assembly are working satisfactorily, the volume immediately above the piston 26 is a more-or-less solid stream of liquid, the volume or time of discharge of which is measured by the meter 120 or a detector.

When the piston 26 reaches the separation rod 70, the ball 36 is dislodged from the piston 26 and falls immediately back into the production string 12. The sleeve 34 slips over the separation rod 70 and strokes the anvil. Any liquid remaining in the well head is driven through the flow line 118 by formation gas. Gas flowing upwardly in the flow paths around the separation rod 70, sleeve 34 and housing 44 creates a pressure drop across the sleeve 34 causing it to stay on the rod 70 against the effect of gravity. When the controller 124 determines that it is time to drop the sleeve 34 and initiate another plunger cycle, a signal is delivered on the wire 116 to energize the motor operator 114 and momentarily close the wing valve 24. This causes the pressure drop across the sleeve 34 to decrease, so that upward force acting on the sleeve 34 drops and the sleeve 34 falls into the production string.

It can also be seen that cycling the sleeve 34 in response to the amount of liquid delivered during the surface allows a relatively small volume of liquid to be produced during each cycle of the piston 26. This prevents damage to the rod assembly 70 and to the downhole bumper assembly 28 caused by the production of no liquid and allows maximum trouble free gas production by keeping the well unloaded to as great an extent as reasonable.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

What is claimed is:

1. A piston assembly comprising:

(a) a sleeve member having an inner surface, the inner surface defining an opening for the flow of formation fluids, the opening having a first section and a second section;

(b) a retention sleeve configured to be affixed to the first section of the opening in the sleeve member; and (c) a flow restriction member without being latched to the sleeve member configured to have an interference fit with the retention sleeve, wherein the force of the interference fit is sufficient to overcome the force of gravity on the flow restriction member when formation fluid forces acting on the flow restriction member are decreased or removed, and wherein the second section of the opening in the sleeve member is configured to prevent the passage of the flow restriction member.

2. The piston assembly of claim 1, wherein the flow restriction member is the form of a sphere.

3. The piston assembly of claim 1, wherein the first section of the opening in the sleeve member contains circumferential protrusions configured to mate with the retention sleeve.

4. The piston assembly of claim 1, wherein the retention sleeve is made from materials selected from the group consisting of: elastomeric materials; soft metals; plastic; rubber; and combinations thereof.

5. The piston assembly of claim 1, wherein the first section of the opening in the sleeve member includes a first width, the second section of the opening in the sleeve member includes a second width, and the retention sleeve includes an opening having a third width to accommodate the flow restriction member.

6. The piston assembly of claim 5, wherein the first width and the third width are larger than the second width.

7. The piston assembly of claim 1, wherein the sleeve member further includes an outer contoured surface configured to create a turbulent fluid flow when the sleeve member is moved in a production tubing.

8. The piston assembly of claim 1, wherein the sleeve member is made from a material selected from the group consisting of stainless steel, chrome steel, cobalt, zirconium ceramic, tungsten carbide, silicon nitride and titanium alloys.

9. The piston assembly of claim 1, wherein the flow restriction member is made from a material selected from the group consisting of stainless steel, chrome steel, cobalt, zirconium ceramic, tungsten carbide, silicon nitride and titanium alloys.

10. The piston assembly of claim 1, wherein the first section of the opening in the sleeve member and the retention sleeve are affixed by an adhesive.

11. The piston assembly of claim 1, wherein the flow restriction member is configured to seal the opening of the sleeve member.

12. The piston assembly of claim 1, wherein the flow restriction member is configured to be movable within the first section of the opening in the sleeve member.

13. The piston assembly of claim 12, wherein the flow restriction member is configured to seal the opening of the sleeve member regardless of the flow restriction member's position in the first section of the opening in the sleeve member.

* * * * *